US005230979A

United States Patent [19]

Chow et al.

[11] Patent Number: 5,230,979

[45] Date of Patent: Jul. 27, 1993

[54] METHOD OF ELECTROSTATIC PRINTING AND TONER USED IN SUCH METHOD

[75] Inventors: Joseph S. Chow, Huber Heights; George A. Gibson, Vandalia; Ray H. Luebbe, Jr., Centerville, all of Ohio

[73] Assignee: AM International, Inc., Chicago, Ill.

[21] Appl. No.: 712,111

[22] Filed: Jun. 7, 1991

[51] Int. Cl.[5] ..... G03G 13/10; G03G 9/12

[52] U.S. Cl. ..... 430/114; 430/115; 430/119

[58] Field of Search ..... 430/114, 115, 119

[56] References Cited

U.S. PATENT DOCUMENTS 4,157,974 6/1979 Brechlin et al. ..... 430/114 X
4,681,831 7/1987 Larson et al. ..... 430/114
5,043,749 8/1991 Punater ..... 346/153.1

*Primary Examiner*—Roland Martin
*Attorney, Agent, or Firm*—Tarolli, Sundheim & Covell

[57] ABSTRACT

A liquid toner for developing electrostatic latent images, at speeds in excess of 100 ft./min., by electrophoretic movement of pre-charged particles of a thermoplastic polymer in a nonpolar carrier liquid, which reduces drag is disclosed wherein the particles are present in about 10% by weight of the weight of the carrier liquid, and no more than 10% by volume of such toner particles having a size less than 1.0 micron as measured by an Horiba Capa-700. The nonpolar liquid has, typically, a volume resistivity in excess of $10^9$ ohm centimeters, a dielectric constant no greater than 3.5, and a vapor pressure of less than 10 millimeters of Mercury at 25 degrees C. The toner composition also includes a quantity of charge director for imparting an electrostatic charge of predetermined polarity to said particles. The toner particles may have a plurality of fibers integrally extending therefrom. Also disclosed is a method of electrostatic printing, at speeds of at least 100 feet-minute, using such liquid developers.

11 Claims, 3 Drawing Sheets

METHOD OF ELECTROSTATIC PRINTING AND TONER USED IN SUCH METHOD

BACKGROUND OF THE INVENTION

The invention relates to liquid toners, and to producing a reduction in image drag (a term later defined herein) in electrostatic printing, particularly high speed electrostatic printing as performed by the apparatus and method disclosed in copending U.S. patent application Ser. No. 07/458,940 filed Dec. 29, 1989, now U.S. Pat. No. 5,043,749, entitled Printing Press and Method, and assigned to the assignee of this application.

Such a press employs (a) digital electronic image creation, generation, and merging; (b) electrophotographic printing, e.g. electrostatic printing of images using liquid toner for image development; (c) the type and versatility of web handling associated with forms presses or the like; (d) web feeding under controlled tension, which in turn contributes to accurate length control, an important factor in continuous forms manufacturing or other repetitive printing wherein the various pages must be of uniform length for further handling; (e) ability to print on a substantial variety of materials, of different thickness or other characteristics; and (f) ability to maintain quality electronically printed product at substantial speeds, in a range of at least 100 to 300 feet/minute (or even greater), and during speed changes within that range. It is to be noted that these speeds are substantially greater than modern electrophotographic copying machines, usually sheet fed, the fastest of which operate at speeds no greater than approximately 100 feet/minute.

The unique printing engine of such press utilizes a drum having a surface photoreceptor, e.g. a photoconductive surface as the active surface on which developed electrostatic images are created, and an offsetting arrangement by which these images are transferred to the forms material, most commonly a paper web. The drum is rotatably driven at a peripheral velocity equal to web speed through the press. Special high intensity charging, exposing-discharging, developing and cleaning systems assure the drum surface has a uniform electrostatic charge, of substantially high potential, applied to its photoreceptor surface each revolution, is selectively discharged by exposure to a radiation pattern to form a latent image, that image is developed with a liquid toner, and after the image is transferred to print receiving material, the surface is then cleared of residual toner, and charged again as the next revolution begins. It should be understood that preferably the photoreceptor surface is continuous, as disclosed in said application, and the aforesaid process occurs continuously as the drum surface progresses past the different stations of the printing engine.

A digital imaging device, preferably in the form of a relatively high intensity LED array mounted to extend transversely of the rotating drum surface, operates to discharge the background or non-image areas of the passing drum surface to a potential substantially lower than the potential of the uniform charge, by exposing individual dot areas to focused radiation at a predetermined frequency and intensity, whereby the remaining or image areas(s) comprise a latent electrostatic image of the printed portions of the form. The size of these dots or pixels provides an acceptably high resolution image for forms printing. The latent image then is carried, as the drum rotates, past a developing station wherein it is subjected to the action of a special high speed liquid toner developer, thus forming a developed or visible image with liquid toner particles, which image is thence transferred and fixed to the paper web or other material. The developer is a special proprietary combination of small particle size toner, having a plurality of fibers integrally extending therefrom, dispersed in a carrier liquid. The liquid developer supply system constantly recirculates developer through a specially constructed shoe, which is closely fitted to the moving drum surface, for example at a spacing of about 500 microns (0.020 inch).

The developer is monitored and refreshed as needed to maintain a predetermined concentration of toner particles in volatile carrier liquid. The developer shoe functions as an electrode which is maintained at a potential in the order of +500 to 600 V DC. Thus the negatively charged toner particles are introduced into the shoe and dispersed among electrical fields between the image areas and the developer electrode, on the one hand, and between the background or non-image areas and the developer electrode on the other hand.

Typically, the electrical fields are the result of difference in potential between the image areas and the developer electrode which causes the toner particles to deposit on the images areas, and between the background areas and the developer electrode which causes toner particles to migrate to the developer shoe in those areas. Thus, the electrical fields in the image and non-image areas are reversed, resulting in a high quality distinction between image and background, and good coverage of solid image areas. The tendency of toner particles to build up on the developer shoe or electrode is overcome by the circulation of liquid toner through the shoe back to the toner refreshing system, as explained in said copending application.

As the drum surface passes from the developer shoe, a reverse rotating metering roll, spaced parallel to the drum surface by about 50 to 75 microns (0.002 to 0.003 inches), acts to shear away any loosely attracted toner in the image areas, and also to reduce the amount of volatile carrier liquid carried by the web with the toner deposited thereon, and to scavenge away any loose toner particles which might have migrated into the background areas. This metering roll has applied to it a bias potential in the order of +200 to 600 V DC, varied according to web velocity.

Details of a suitable charging system are disclosed in U.S. Pat. No. 5,017,964 issued May 21, 1991. Details of a developer supply system are disclosed in U.S. Pat. No. 5,019,868 issued May 28, 1991. An example of such toner is disclosed in U.S. Pat. No. 4,794,651, particularly Example 1 therein. Details of the reverse metering roll system are also disclosed in said U.S. Pat. No. 5,019,868. The web path then leads t o an image transfer station where idler rollers guide the web material into contact with a band-like area across the drum surface. Behind the web path at this location is a transfer corotron to which is applied a high DC voltage. The web is driven at a speed equal to the velocity of the drum surface to minimize smudging or disturbance of the developed image on the drum surface, and to assure that the printed image is of the proper length. Typical web speeds for such a press are in the range of 100 to 300 ft./min. Both toner particles and liquid carrier transfer to the web, including carrier liquid on the drum surface in the background areas.

In operation of such a press, a condition which has been named "drag" has been observed under certain circumstances. Drag is an image defect characterized by the appearance of toner particles deposited in areas that should contain no information, following a printed area, e.g. the particle deposits are found downstream along the print receiving material or media from printed areas, in the direction of travel of the print receiving media, in a diminishing trail. The magnitude of this defect has been found to depend upon the size of the gap between the photoconductor drum and the reverse roller, the speed at which printing is taking place (i.e. print material or web speed), and upon the toner used. The amount of drag observed has also been found to respond to the electrical process parameters that delimit toner development, developer electrode bias and reverse roll potential are shown to have some effect. The product of drag is made visible as a relatively small amount of toner, it is a relatively low density image figure, and therefore factors effecting transfer will effect drag as well. If a paper shows poor transfer characteristics in general, e.g., papers that are rough, drag will be less apparent.

The profound speed dependence of noticeable drag has kept this condition from even being observed in prior liquid toner imaging machines. Since the press as disclosed in said copending application Ser. No. 07/458,940, now U.S. Pat. No. 5,043,743 prints much faster than copiers or similar devices that use liquid toner imaging, drag is a major concern in that press. The amount of drag has been observed to increase as the printing speed increases, all other things remaining constant.

Prior art liquid developers have, in general, exhibited a trend toward smaller particle sizes. Many prior art patents speak in terms of submicron particle sizes, ranging up to no more than 10 microns, and in many cases up to no more than 2 microns. By way of example only, prior U.S. patents disclosing such examples are U.S. Pat. No. 3,926,825 (from about 0.01 to 10 microns), U.S. Pat. No. 3,954,640 (5 microns or less), U.S. Pat. No. 4,307,168 (preferred range of from about 0.1 to about 2.0 microns), U.S. Pat. No. 4,357,406 (not larger than 10 microns), and U.S. Pat. No. 4,476,210 (typically 0.4 microns, maybe as broad as 0.1 to 1 micron). The trend has been to achieve very small particle sizes, mostly in a effort to improve image resolution.

SUMMARY OF THE INVENTION

This invention relates to an improved liquid toner for use particularly in high speed electrostatic printing operations, e.g. at speeds in the order of at least 100 feet/minute up to 300 feet/minute or even greater, and to a method of printing using such a toner. The invention is the result of recognition of the condition identified as drag, and overcoming this condition by providing a liquid toner having an actual particle size distribution in which toner particles contain less than about 14% submicron fines, ideally less than 10% submicron fines, by volume based on the total volume of particles. This may be accomplished by reduction, by about one-third, of the time of the slurry grinding step in the process of manufacturing the liquid toner. It is also possible to utilize centrifuging or particle classification techniques. The resulting liquid toner retains the required good resolution while avoiding visible drag conditions in printed material.

Thus, the invention recognizes that, contrary to what might be expected, very small particle sizes, at least in some liquid toners, are detrimental rather than helpful. Additional benefits are achieved by reason of greater gravitational stability of this toner. The absence, or minimizing, of submicron particles results in little or no settling of particles if the toner is left standing. Also, with the preferred toner recirculation system, the printing engine can use the somewhat larger particle sizes effectively. Moreover, if the toner particles should tend to flocculate if left standing for a substantial time, when the system starts the toner recirculation pump will quickly function to re-disperse the particles.

DESCRIPTION OF THE PREFERRED EMBODIMENT THE PRINTING APPARATUS

Figure 1:
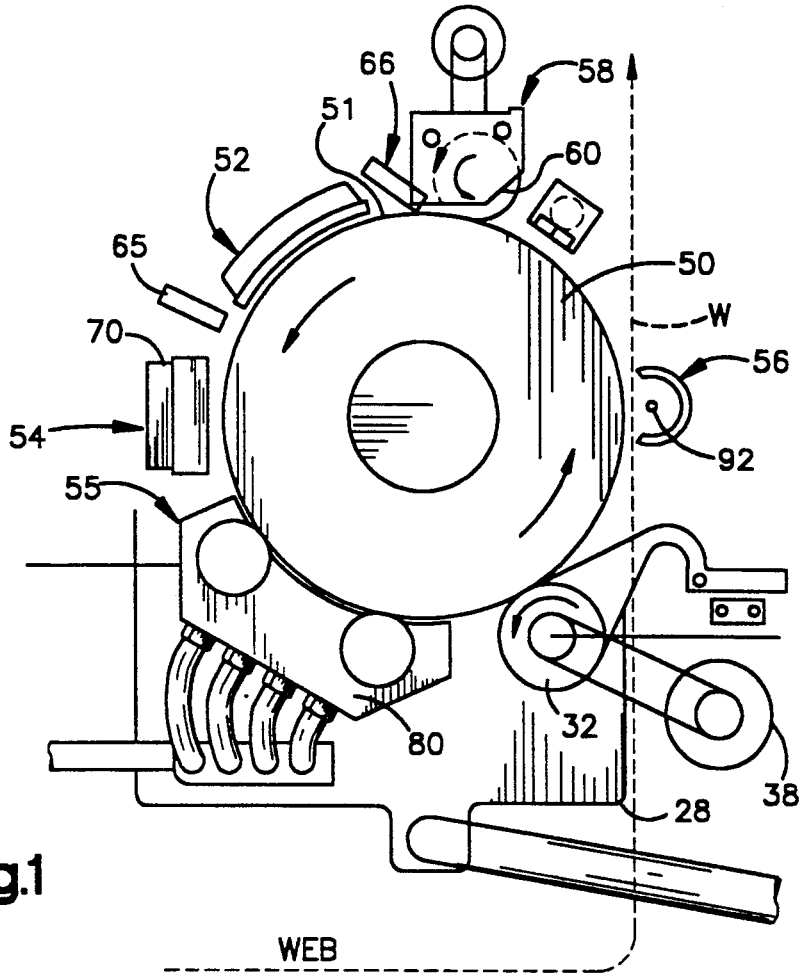
FIG. 1 is a diagrammatic view of one print engine of an electrostatic press to which the present invention applies.

Referring particularly to FIG. 1, a printing engine utilizes a rotatable drum 50 having an active photoreceptor surface 51; on which developed electrostatic images are created, and an offsetting arrangement by which these images are transferred to the web material W (shown in dash lines). The drum is rotatably driven at a peripheral velocity equal to web speed through the press, and drum surface 51 is a light sensitive photoconductor (for example $As_2Se_3$) which behaves as an insulator in dark, and a conductor when exposed to light.

Systems are arranged sequentially around drum 50, as shown in FIG. 1, to accomplish the desired formation and transfer of images onto the web. These systems include a high intensity charging apparatus 52, exposing-discharging (or imaging) apparatus 54, developing apparatus 55, transfer apparatus 56 and cleaning apparatus 58. These assure that regions of the drum surface during each revolution have a uniform electrostatic charge applied to its photoreceptor surface, then a latent image is formed on the surface, developed with a liquid toner, and the developed images are continually transferred to the web, after which the surface is essentially discharged, cleared of residual developer materials, and again uniformly charged. This entire operation preferably proceeds continuously. Where dimensions are stated, they are exemplary based on a successful embodiment.

Counterclockwise around the drum from charging apparatus 52 there is a charge potential sensor 65 which senses the voltage at the surface 51 and provides a continuous feedback signal to a charging power supply, thereby adjusting the charge level of the photoreceptor surface 51 regardless of variations due, for example, to irregularities in the power supply or changes in the surface velocity of drum 50.

The digital imaging device 54, in the form of a relatively high intensity LED (light emitting diode) double row array 70, is mounted extending transversely of drum surface 51. Each LED is individually driven from a corresponding driver amplifier circuit and emits light through a self focusing lens onto drum surface 51 in a dot or pixel size of, for example, 0.0033 inch diameter. In one successful embodiment there are 6144 LEDs in the array, divided between two rows which are spaced apart in a direction along the circumference of the surface by 0.010 inch. The space between adjacent LEDs in the same row is 0.0033 inch horizontally, and the LED arrays in the two rows are offset horizontally by the same dimension. Thus by delaying the driving of the second row, the LEDs can cooperate to discharge selected one of a continuous series of adjacent dot areas or pixels across drum surface 51 at a resolution of 300 dots/inch.

Light from the LEDs discharges non-image areas of the passing drum surface to a substantially lower potential (as described in said copending application Ser. No. 07/458,940, now U.S. Pat. No. 5,043,749) by exposing dot or pixel areas to radiation. The remaining or image areas(s) comprise a latent electrostatic image of the printed portions of the form. The size of these dots provides an acceptably high resolution image. This discharging of small drum surface areas, on a digital basis, is accomplished within small tolerances over a range of web speeds from 100 to 300 feet/minute.

The latent electrostatic image then is carried, as the drum rotates, past developing apparatus 55 where it is subjected to the action of a special high speed liquid toner developer, thus forming a developed or visible image with merged toner particles, which image is thence transferred and fixed to the paper web or other material. The developer is characterized generally as toner particles of appropriate size dispersed in a nonpolar liquid carrier having a volume resistivity in excess of $10^9$ ohm centimeters, a dielectric constant no greater than 3.5, and a vapor pressure preferably of less than 10 millimeters of mercury at 25 degrees C.

The developing station 55 comprises a shoe member 80 (which also functions as a developer electrode) and extends across drum surface 51. The face of shoe member 80 is curved to conform to a section of drum surface 51, and extends along its arcuate face about one sixth of the drum circumference. The shoe member is closely fitted to the moving drum surface, for example at a spacing of about 500 microns (0.020 inch). The shoe is pivotally connected at its opposite side to control levers which are urged to move shoe 80 toward drum surface 51.

The developer is monitored and refreshed as needed to maintain a predetermined concentration of toner particles in volatile carrier liquid at the desired negative charge, as explained in U.S. Pat. No. 5,003,352 issued Mar. 26, 1991 and in said U.S. Pat. No. 5,019,868.

Developer shoe 80 functions as an electrode which is maintained at a potential in the order of +50 to 500 V DC. Thus negatively charged toner particles are introduced into the shoe cavities and dispersed among electrical fields between the image areas and the developer electrode, on the one hand, and between the background or non-image areas and the developer electrode on the other hand. Expressed another way, the electrical fields in the image and non-image areas are reversed, and the field in image areas is in the order of at least 1 to 2 V/micron, while the field in non-image areas is in the order of 0.2 V/micron in the reverse field direction. The result is a high quality distinction between image and background, and good coverage of solid image areas. The tendency of toner particles to build up on the developer shoe or electrode is overcome by the circulation of liquid toner through the shoe.

As the drum surface passes from the developer shoe, a reverse rotating metering roll 32, driven by a motor 38 and spaced parallel to the drum surface by about 50 to 75 microns, acts to shear away any loosely attracted toner in the image areas, and also to reduce the amount of carrier liquid carried onward by drum surface 51 with the toner deposited thereon, and to scavenge away any loose toner particles which might have migrated into the background areas. This metering roll has applied to it a bias potential in the order of +50 to 500 V DC, varied according to web and drum surface velocity.

Transfer apparatus 56 includes a pair of idler rollers (not shown) which guide the web onto the "3 o'clock" location of drum 50, and behind the web at this location is a transfer corotron 92. The web is driven at a speed equal to the velocity of drum surface 51, to minimize smudging or disturbance of the developed image on the surface 51, and to maintain the correct image length on the web, and is guided against drum surface 51 such that the width (top-bottom) of the web-drum surface contact is about 0.5 inch, centered on a radius of the drum which intersects the corotron wire.

The transfer apparatus focuses the ion "spray" from the corotron onto the web-drum contact band on the reverse side of the web, and its operation results in a transfer efficiency of at least 95%; e.g. at least 95% of the toner particles are transferred to web W. Both toner particles and carrier liquid transfer to the web, including carrier liquid on the drum surface 51 in the background areas. The web path continues into a fuser and dryer apparatus (not shown) wherein the carrier liquid is removed from the web material and the toner particles are fused thereto.

Cleaning apparatus 58 removes all toner particles and all carrier liquid from drum surface 51. Its open cell foam roller 60 rotates in the opposite direction to drum surface motion, as indicated by the arrow, so as to compress against and scrub surface 51. This action draws carrier liquid and any included toner particles remaining on the surface 51 off that surface and into the cells of roller 60. A cleaning blade 66, comprising a longitudinally stiff, but flexible width-wise, polyurethane wiper blade, is mounted with its edge extending forward and into contact with surface 51, just beyond foam roller 60, and acts to wipe dry the drum surface 51, since the photoconductor surface must be dry when it reaches the charging station.

DRAG CONDITIONS

Figure 3:
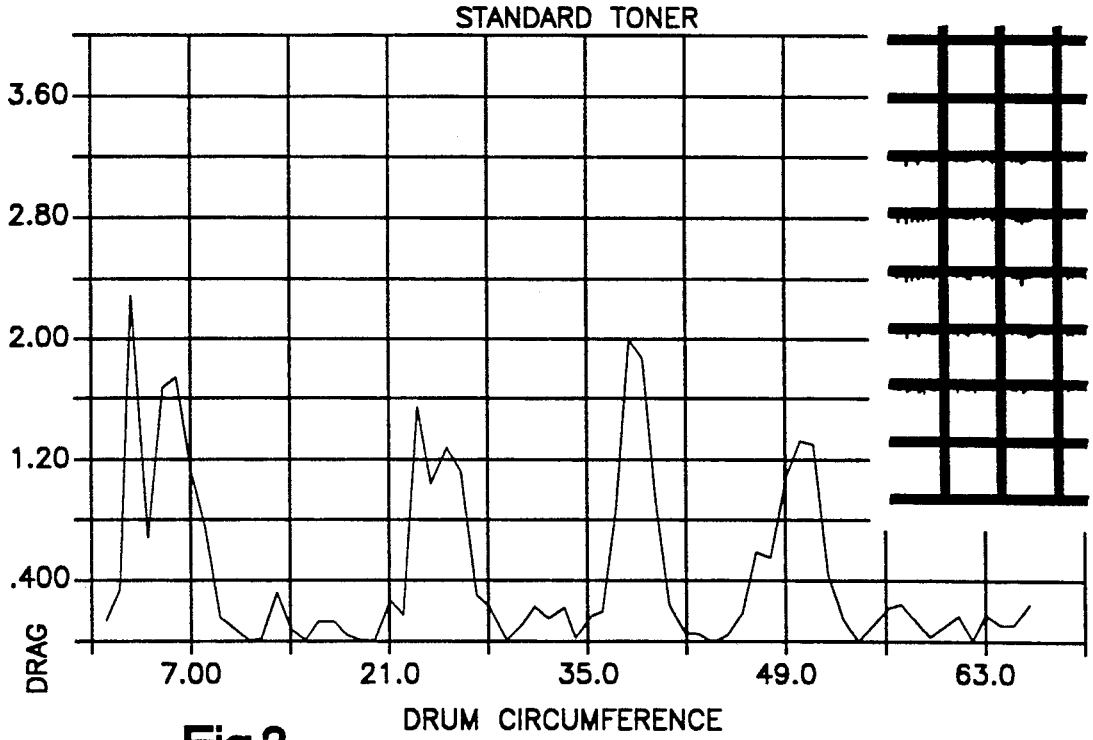
FIG. 3 is a plot of drag conditions observed using a standard toner (as described herein), together with a reproduction of a portion of the corresponding target pattern.

The condition which has been named "drag" has been observed under certain circumstances in the operation of such a press. Drag is characterized by the appearance of toner particles deposited in areas that should contain no information, following a printed area, e.g. toner particle deposits are found downstream along the print receiving material or media from printed areas, in the direction of travel of the print receiving media, in a diminishing trail, as shown in FIG. 3. The magnitude of this defect has been found to depend upon the size of the gap between the photoconductor surface 51 and reverse roller 32, the print material or web speed, and upon the toner used. The amount of drag observed has also been found to respond to the electrical process parameters that delimit toner development, developer electrode bias and reverse roll potential are shown to have some effect. The product of drag is a relatively small but visible amount of toner, and therefore factors effecting transfer will effect drag as well. As the gap between the reverse roller and the photoconductor increases, the amount of drag has been observed to increase. This dependence is sufficiently strong that variations in gap which occur, because of the normal deviations from ideal cylindrical geometry of the drum and reverse roller, produce bands of greater and lesser amounts of drag.

Figure 2:
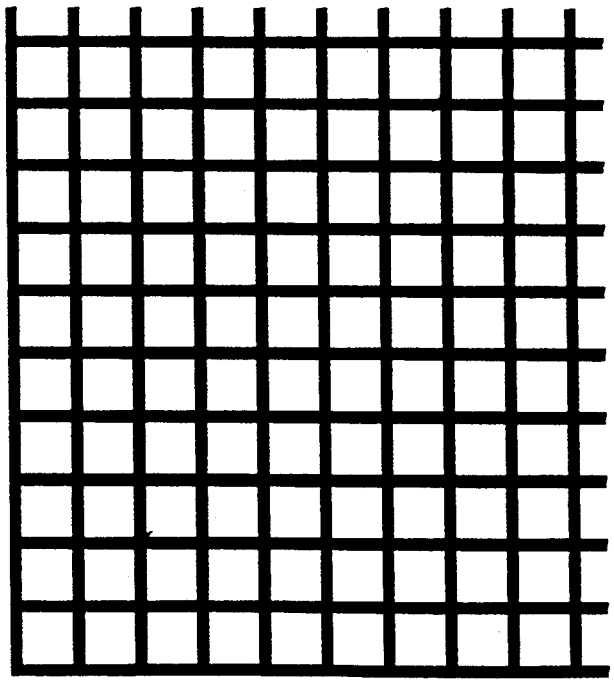
FIG. 2 is a reproduction of a portion of the target pattern used to determine drag conditions.

Thus drag effects are difficult to quantify and any single number characterization is incomplete at best. This difficulty has been avoided by use of a scanning system, which, in conjunction with a specially designed target, allows drag to be measured over the entire drum circumference. The target is a grid formed from parallel lines in and perpendicular to the process direction, and is illustrated in FIG. 2. A strip print of this target configuration is then made on the apparatus and can be analyzed for drag at every line perpendicular to the direction of web motion, i.e. transverse of the web.

This is accomplished by making one or more prints of the target on the press and mounting such print to a plotter drive, then using a video camera to digitize the image of each strip in turn. Once the image of a strip is acquired, the bit map of the image can be used to compare the edge sharpness of the leading edge to that of the trailing edge of the transverse lines. The resulting difference is called drag and is plotted against position. A total or integrated drag number can be obtained by use of digital integration or simply by cutting out the area defined by the curve and weighing it. In this case, the units of drag become grams.

Using this measurement scheme, the effects of toner particle size distribution on drag were investigated. Using a standard toner (of the sort described in said U.S. Pat. No. 4,794,651) the amount of drag observed was related to the amount of the toner particle size distribution which can be roughly called "fines".

Particle sizing is a complicated discipline. While there are some particles (e.g. spherical particles that are not modified by interaction with their environment) which have a relatively well defined and unambiguous particle size, these are the exception and not the rule. Minimally, characterizations of particles must specify a range and some average or mean.

More desirably, the distribution can be described as a collection of fractions of the distribution characterized by particle size increments that are small with respect to the overall range of sizes in the sample. When the particles that make up a given sample are of irregular shape or when they are inhomogeneous with respect to some physical property, the situation becomes more complex. A Stokes' law size determination of the size distribution of hollow glass spheres will be difficult on most commercial equipment, for instance, because the density of the spheres changes with their diameter. Similar problems arise in cases where particles have an aspect ratio that causes orientation in the measurement device, a needle shaped particle will, for instance, sediment differently if its long axis is caused to be parallel with the direction of the gravitational vector than if such particle is perpendicular to such force. Optical techniques may be confounded by materials that are not optically homogeneous, as many such techniques rely on the existence of only two regions of distinctly different refractive index. Further, there are media and sample preparation problems that may be encountered.

Many particulates form aggregates of primary particles so care must be taken to understand the nature of the species being sized. In liquid dispersions, this often takes the form of a dependence of apparent particle size on concentration. Finally, the particulate may interact with its environment in a way that makes some of the assumptions on which the particle measuring technique is based inaccurate. A particulate may, for instance, be swollen by the liquid in which it is dispersed. Sizing techniques that rely on a single sharp change in refractive index may then given erroneous results in such a case.

Thus, the particular particle size distribution obtained for a sample is a sensitive function of the exact way in which it was measured. Sample preparation and the appropriateness of the chosen technique will determine whether useful information can be obtained in a given set of measurements. It is well known in the toner art, that as a consequence of the concerns expressed above, two measurements on the same sample using different techniques and with different sample preparation regimens will often yield different results. When discussing, therefore, a distribution of some average size and polydispersity, the measurement conditions must be specified.

Accordingly, when discussing changes in particle size distribution that have the effect of substantially eliminating drag, it must be understood that it is the trend that is important, not the absolute numbers.

Figure 4:
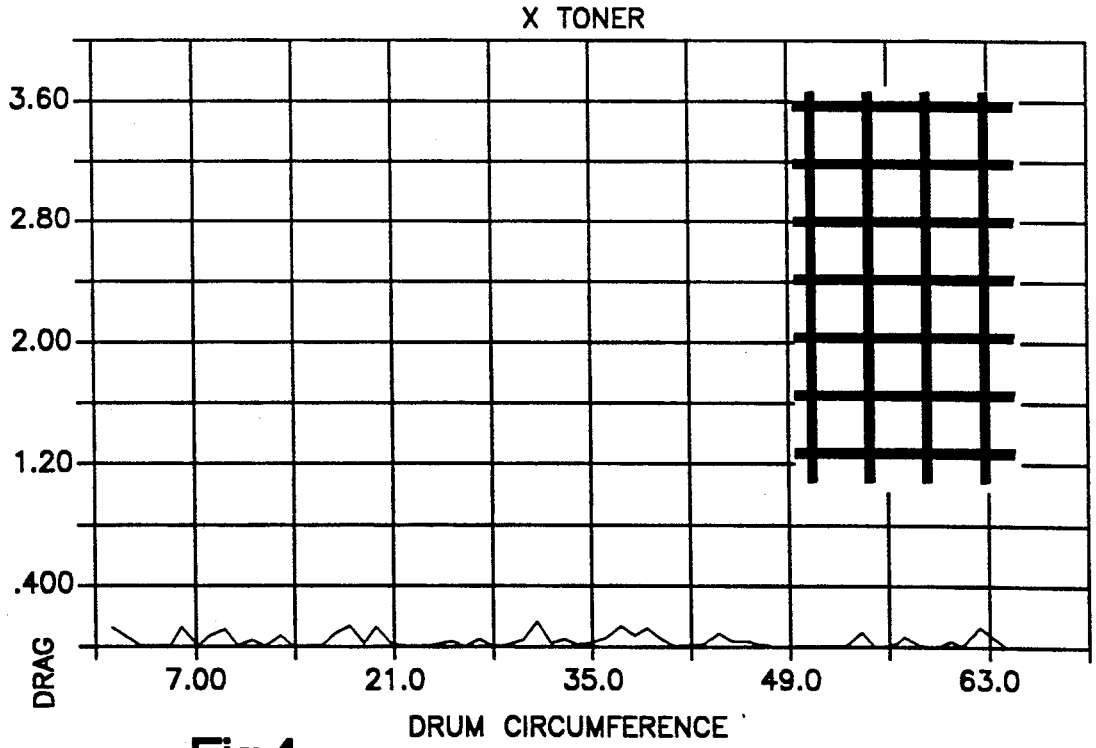
FIG. 4 is a plot and a reproduction similar to FIG. 3, using the improved toner according to the invention.

FIGS. 3 and 4 are reproductions of samples which are results of measurements made of drag produced on a press as disclosed in said copending application Ser. No. 07/458,940, now U.S. Pat. No. 5,045,749. FIG. 3 illustrates the results obtained with a standard toner. Considerable drag is observed and distinct banding is evident. The numbers on the abscissa represent bar numbers, so in total 66 bars were scanned. The drag condition can also be observed on the reproduced fragment or inset of the target. FIG. 4 illustrates the results obtained with the improved toner of the present invention, which is known as "X toner". In this case, both the drag and the associated periodicity are markedly suppressed. The difference between these two toners is particle size distribution. The improved toner has a significant reduction in the relative fraction of particles that would be considered fines.

Figure 5:
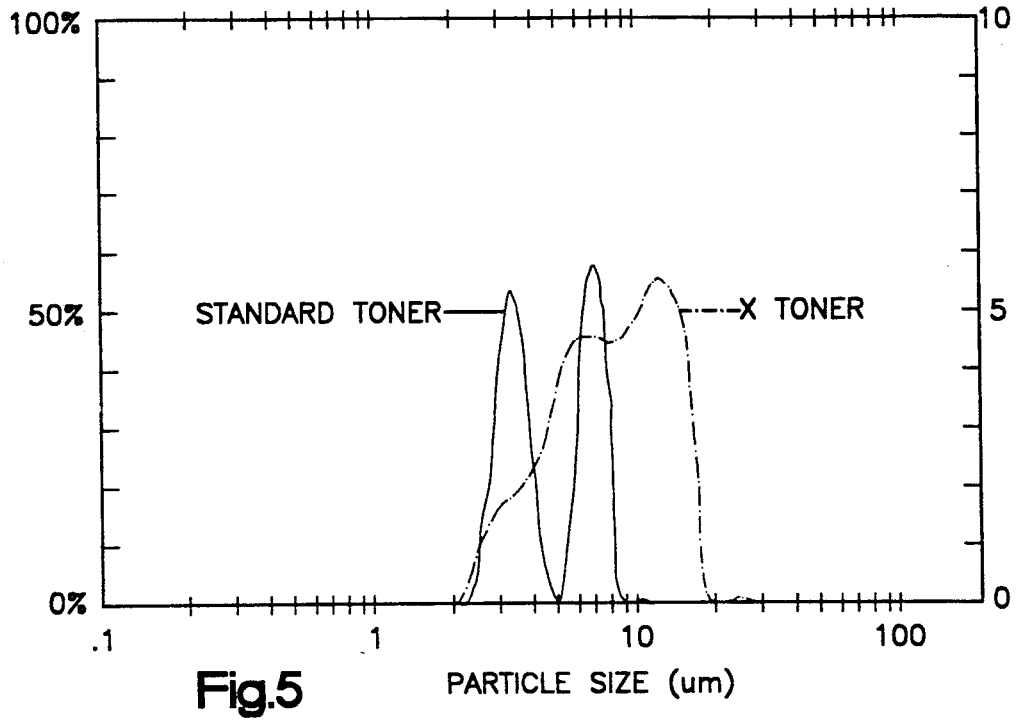
FIG. 5 is a plot of the particle size distribution in both a standard and the improved toners, as measured by a Malvern laser light scattering particle size analyzer.
Figure 6:
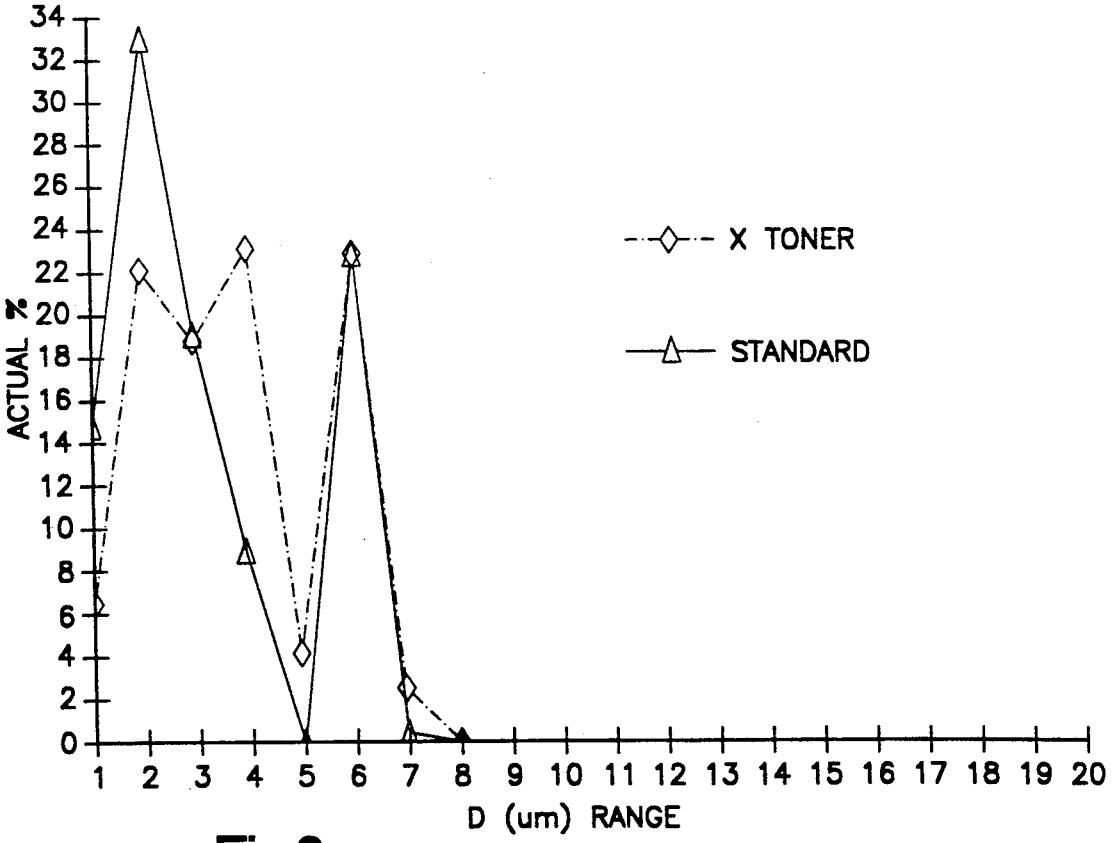
FIG. 6 is a plot of particle size distribution in a standard toner and the improved toner, using the Horiba Capa-700 instrument.

FIG. 5 presents the particle size distributions of the two toners as measured by the Malvern Series 2600 laser light scattering particle size analyzer. This is a Fraunhoffer diffraction type device. Clearly both the average particle size and the fraction of the sample that is at the small end of the distribution change dramatically. When these same samples are sized by use of an Horiba Capa-700, the picture of the particle size distribution that arises is dramatically different (see FIG. 6). While the standard toner is still shown to be distinctly bimodal and while the cusp of the distribution is still shown at 5 microns the similarity ends there. The Horiba test (FIG. 6) shows standard toner as possessing in the order of 15% (by area) of its particles in the 1 micron and less range, whereas the Malvern test (FIG. 5) had not seen any particles smaller than 2 microns.

The Horiba test shows a cusp in the distribution of reduced drag toner at 5 microns, which is completely missing in the Malvern measurement. Finally, there are significant differences in the fraction of the distributions greater than 8 microns. The Malvern device indicated a considerable fraction of the mass of the reduced drag toner at sizes above 10 microns, whereas the Horiba device does not indicate any fraction of either toner above 8 microns. It is therefore concluded that the Malvern system is not measuring the absolute particle size but rather the size of aggregates, whereas the Horiba device does measure absolute particle size. In either measurement technique, there are clear and well definable differences between the improved or X-toner and the standard toner.

It is therefore concluded that the particle size distribution, as well as the median or average particle size, is an important determinant in toner performance and that, contrary to the general expectations, smaller particle size is not always better, as would be expected from the prior art teachings exemplified by the prior art patents identified in the Background section of this application. Rather, it has been discovered that the image defect, drag, is related to the number of fines in a toner sample. When the fraction of fundamental particles in the less than 1 micron range (submicron range) is reduced, the severity of drag is reduced.

Generally, the improved toner produced according to this invention contains less than 14% (by volume) submicron fines, preferably less than 10% by volume of such fines. As the fraction of fines is reduced from ca. 14% the performance of the toner steadily improves.

Care must be taken not to let the fraction of large particles become so big, as one reduces the fraction of fines, that resolution and optical density are sacrificed. Too much predominance of large particle size can cause decreased particle mobility and loss of resolution. The preferred toner particle size is that which achieves good resolution, and has a particle size in the range of 1.5 to 5 microns, and less than 10% of the particles, by volume fraction, have a particle size above 10 microns. The appropriate particle size will, therefore, depend to some extent upon the particular application.

Methods of producing toners with reduced fines content include, but are not limited to, decreasing the grind time in a media mill and heat treatment, which causes the fines to aggregate forming larger particles.

The standard toner is prepared in a Ross fifty liter planetary jacketed mixer. The mixing elements of such mixer are operated to revolve at about 20 rev./min. In such mixer are blended 8500 grams of NUCREL (du Pont) 699 polymer with 4250 grams of ISOPAR V vehicle (Exxon) at a temperature of 90 degrees C. to plasticize the polymer. Then, 2835 grams of carbon black (MOGUL L, Cabot Corporation) pigment are added and mixed until the pigment is dispersed, in approximately one hour. Then, stirring is continued while 22,000 additional grams of ISOPAR V are added over a period of two hours. When the material is homogeneous, heating is stopped while stirring is continued.

The mixture is cooled to a temperature of about 25 degrees C., preferably while continuing stirring and while allowing the mixture to cool. This permits precipitation of pigmented particles out of the dispersion formed by addition of the added ISOPAR V, and encapsulates or otherwise associates the pigment with the polymer. When the newly formed pigmented toner particles have thus been made, they are present in about 30% by weight with respect to the weight of the liquid. Other nonpolar liquids having elevated vapor pressures, such as other ISOPARs or light hydrocarbon oils, may be used as liquids. Other polymers known to those skilled in the art may be used, as may other pigments and dyes.

The 30% slurry is removed from the planetary mixer, diluted with a more volatile solvent, e.g. ISOPAR H to 10% solids, and placed in a 100S Union Process Attritor containing 3/16th inch stainless steel balls. The slurry is ground in the Attritor for approximately 21 hours, at which time the particle size is that of the standard toner, as determined by the methods described above, having about 15% fines (see FIG. 6, double line representing the standard toner). The slurry is then used in the press in accordance with the disclosure of U.S. Pat. No. 5,003,352 issued Mar. 26, 1991, with the appropriate addition of a liquid charge control agent as explained in that patent.

The improved X-toner is prepared initially in the same manner. However when the slurry is reduced to 10% solids and placed in the Attritor, the slurry is ground only for approximately 8 hours, or about one-third the grinding time of the standard toner. The result is less percentage of fines; note FIG. 6, single line representing the X-toner, where the percentage of particles having a size of no more than 1 micron is approximately 6%.

The target test for the standard toner (FIG. 3) exhibits noticeable drag on the sample inset, and the amount of drag across the target is clearly apparent. However, when the same target test is performed using the improved or X-toner, the deposits due to drag conditions are reduced to the point of being imperceptible, as shown on the inset in FIG. 4 and demonstrated on that graph.

Other methods of obtaining the desired particle size distribution, as defined by this invention, will be apparent to those skilled in this art. For example, centrifugation techniques are known. When density is constant, sedimentation velocity depends upon the balance of centripetal acceleration and Stokes drag. This technique is well documented, as for the purpose of achieving separation by article size. Known commercial devices use this technique to analyze materials for particle size distribution, and are identified as field flow fractionation equipment.

An agglomeration technique may also be used. In this technique, the dispersion is heated to a temperature above the softening point of the particulate phase. Moderate agitation then causes a preferential depletion of the small particles in the distribution.

A filtering technique can also be employed, using a filter with a pore size such that small particles will pass freely through the filter, thus providing for concentration of the dispersion. Then, re-suspension of the concentrate will give a desired distribution of particles, preferentially depleted of the undesired smaller particles.

The improved toner provided by this invention can be used in place of standard toner with no reduction in print quality for all types of jobs, and it is better capable of operating on jobs run at higher speeds, especially where the printed material includes solid lines or areas extending transversely to the web length.

While the process and product herein described constitute preferred embodiments of the invention, it is to be understood that the invention is not limited to this precise process and product, and that changes may be made therein without departing from the scope of the invention which is defined in the appended claims.

What is claimed is:

1. A liquid toner composition for developing latent electrostatic images, at speeds of at least 100 ft./min., which reduces drag consisting of a nonpolar liquid having a volume resistivity in excess of $10^9$ ohm centimeters, and a dielectric constant no greater than 3.5;

a quantity of thermoplastic polymer toner particles; a quantity of charge director for imparting an electrostatic charge of predetermined polarity to said particles; and approximately 10% or less of said toner particles by volume have a particle size less than 1.0 micron as measured by an Horiba Capa-700.

2. A liquid toner as defined in claim 1, wherein said particles have a plurality of fibers integrally extending therefrom.

3. A liquid toner as defined in claim 1, wherein said liquid has a vapor pressure of less than 10 millimeters of Mercury at 25 degrees C.

4. A liquid toner as defined in claim 1, wherein the average toner particle size on a volume basis is 1.5 to 5 microns.

5. A liquid toner as defined in claim 1, further including a pigment or dye dispersed therein.

6. The method of electrostatic printing using a liquid toner as defined in claim 1 comprising the steps of:

(a) providing a substrate having a photoreceptor surface;

(b) advancing said substrate at a speed in excess of 100 ft./min.;

(c) forming a latent electrostatic image on said surface;

(d) developing said image using said liquid toner; and (e) transferring said developed image to a print receiving material moving at the same speed as said substrate.

7. In a liquid toner for developing electrostatic latent images at speeds of at least 100 ft./min., which reduces drag. by electrophoretic movement of pre-charged particles of a thermoplastic polymer in a nonpolar carrier liquid, said liquid having a volume resistivity in excess of $10^9$ ohm centimeters, and a dielectric constant no greater than 3.5 the improvement comprising said particles being present in about 10% by weight of the weight of the carrier liquid, and approximately 10% or less of said toner particles by volume have a particle size less than 1.0 micron as measured by an Horiba Capa-700.

8. A liquid toner as defined in claim 7, wherein the average toner particle size on a volume basis is 1.5 to 5 microns.

9. A liquid toner as defined in claim 7, further including a pigment or dye dispersed therein.

10. The method of electrostatic printing using a liquid toner as defined in claim 7 comprising the steps of:

(a) providing a substrate having a photoreceptor surface;

(b) advancing said substrate at a speed in excess of 100 ft./min.;

(c) forming a latent electrostatic image on said surface;

(d) developing said image using said liquid toner; and (e) transferring said developed image to a print receiving material moving at the same speed as said substrate.

11. A method of electrostatic printing at speeds in excess of 100 ft./min., which reduces drag, comprising the steps of a) repeatedly moving a photoreceptor surface past an imaging device and forming a latent electrostatic image on the photoreceptor surface during each passage, b) developing each latent image by flooding the photoreceptor surface with a liquid developer, said developer including pre-charged particles of a thermoplastic polymer in a nonpolar carrier liquid having a volume resistivity in excess of $10^9$ ohm centimeters, and a dielectric constant no greater than 3.5, which particles are caused to migrate by electrophoretic movement to image areas of the photoreceptor surface, said particles being present in a minor amount of about 10% by weight with respect to the weight of the carrier liquid, and no more than 10% of such toner particles by volume having a size less than 1.0 micro as measured by an Horiba Capa-700, and c) transferring the toner particles from the photoreceptor surface to a print receiving material moving at the same velocity as the photoreceptor surface, whereby drag of fines in the developer away from the image areas is avoided as the images are repeatedly created, developed, and transferred to the print receiving material.

* * * * *